US011760593B2

(12) United States Patent
Yamamoto

(10) Patent No.: US 11,760,593 B2
(45) Date of Patent: Sep. 19, 2023

(54) SHEET FEEDING MECHANISM

(71) Applicant: TOSHIBA TEC KABUSHIKI KAISHA, Tokyo (JP)

(72) Inventor: Mikio Yamamoto, Izunokuni Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 122 days.

(21) Appl. No.: 17/523,812

(22) Filed: Nov. 10, 2021

(65) Prior Publication Data

US 2022/0281701 A1 Sep. 8, 2022

(30) Foreign Application Priority Data

Mar. 2, 2021 (JP) ..... 2021-032469

(51) Int. Cl.

| | |
|---|---|
| ***B65H 3/56*** | (2006.01) |
| ***B65H 3/66*** | (2006.01) |
| ***B65H 3/06*** | (2006.01) |
| ***B65H 3/52*** | (2006.01) |
| ***B65H 3/68*** | (2006.01) |

(52) U.S. Cl.

CPC ..... *B65H 3/56* (2013.01); *B65H 3/0676* (2013.01); *B65H 3/5215* (2013.01); *B65H 3/5223* (2013.01); *B65H 3/66* (2013.01); *B65H 3/68* (2013.01)

(58) Field of Classification Search

CPC ... B65H 3/06; B65H 3/34; B65H 3/46; B65H 3/5207; B65H 3/5215; B65H 3/5223; B65H 3/56; B65H 3/66; B65H 3/68; B65H 2404/61; B65H 2404/74; B65H 2404/741; B65H 2404/743

See application file for complete search history.

(56) References Cited

U.S. PATENT DOCUMENTS

| | | | | |
|---|---|---|---|---|
| 6,102,389 | A * | 8/2000 | Sakurai | B65H 3/5223 271/155 |
| 10,968,061 | B2 * | 4/2021 | Aoyama | B65H 3/5215 |
| 2007/0138736 | A1 * | 6/2007 | Lien | B65H 1/04 271/161 |
| 2011/0006474 | A1 * | 1/2011 | Ikeda | B65H 3/0607 271/264 |
| 2015/0210490 | A1 * | 7/2015 | Katsura | B65H 3/5223 271/121 |
| 2016/0282788 | A1 * | 9/2016 | Itabashi | B65H 5/36 |
| 2022/0411212 | A1 * | 12/2022 | Oshiro | B65H 3/0676 |

FOREIGN PATENT DOCUMENTS

| | | |
|---|---|---|
| JP | 2004-137021 A | 5/2004 |
| JP | 2015-171938 A | 10/2015 |
| JP | 2016-052951 A | 4/2016 |

* cited by examiner

*Primary Examiner* — Prasad V Gokhale

(74) *Attorney, Agent, or Firm* — Kim & Stewart LLP

(57) ABSTRACT

According to an embodiment, a sheet feeding mechanism includes a first elastic body. The first elastic body blocks a first reference line and a second reference line. The first elastic body has a first angle formed between the first elastic body and the first reference line, the first angle being an acute angle. The first reference line is a reference line along a take-out direction by the first roller. The second reference line is a reference line connecting a nip between the second roller and the third roller and a contact position of the first roller and a sheet.

10 Claims, 9 Drawing Sheets

SHEET FEEDING MECHANISM

CROSS-REFERENCE TO RELATED APPLICATIONS

This application is based upon and claims the benefit of priority from the prior Japanese Patent Application No. 2021-032469, filed on Mar. 2, 2021, the entire contents of which are incorporated herein by reference.

FIELD

An embodiment to be described here generally relates to a sheet feeding mechanism.

BACKGROUND

In the past, for example, an image processing apparatus that is an MFP (Multi-Function Peripherals) includes a sheet feeding mechanism. A plurality of sheets is stacked and housed in the tray of the sheet feeding mechanism in the thickness direction of the sheets. A problem occurs when a plurality of sheets is transported from the sheet feeding mechanism at a time (hereinafter, referred to as double feeding of sheets). The sheet feeding mechanism does not have the function of causing the uppermost sheet to pass therethrough and blocks the sheets below the sheet (hereinafter, referred to as the separating function) in some cases. Meanwhile, the sheet feeding mechanism is equipped with an expensive rubber material, a dedicated frictional member for enhancing the separating function, or the like to support the double feeding of sheets in some cases.

DETAILED DESCRIPTION

Figure 1:
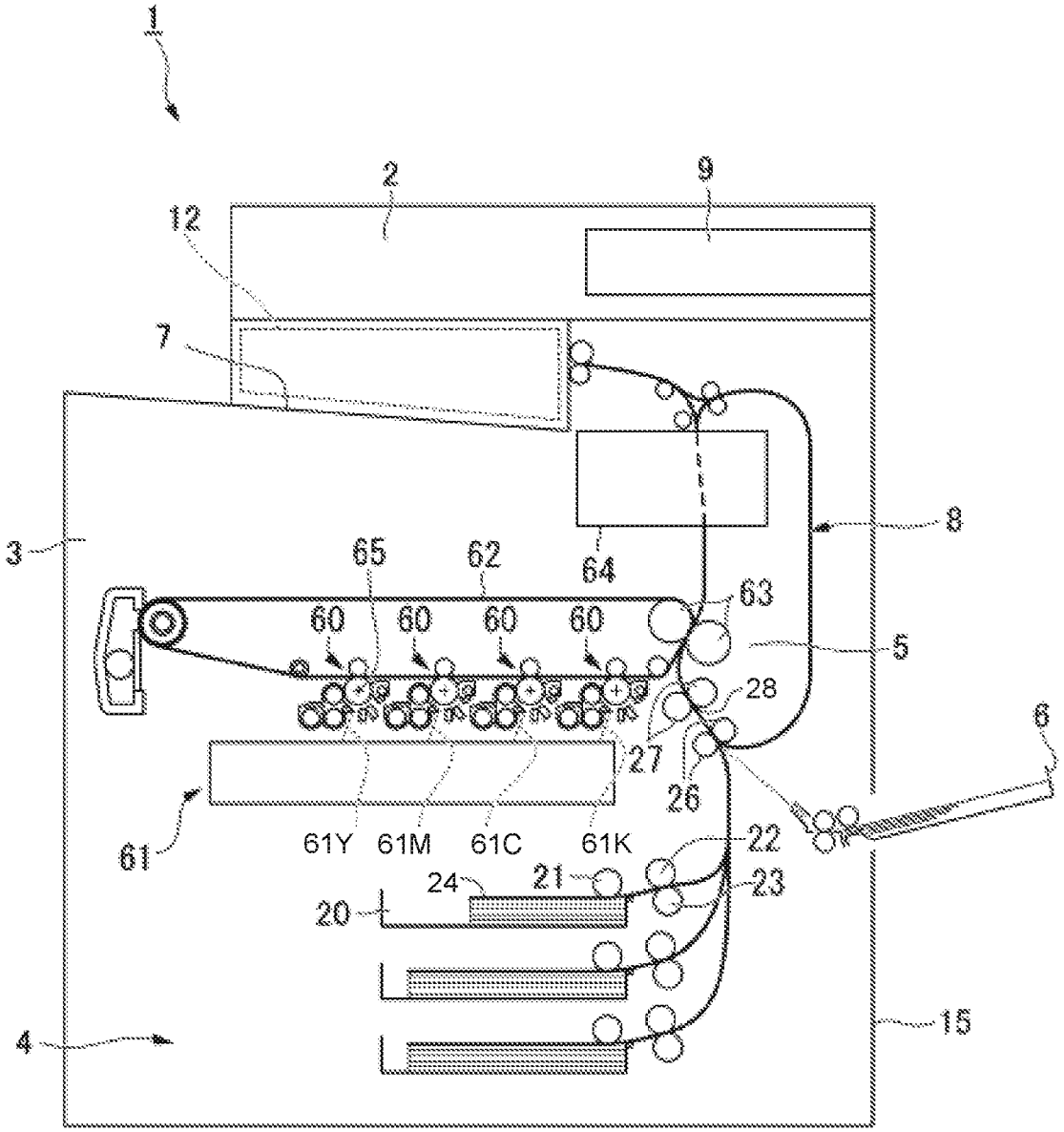
FIG. 1 is a schematic cross-sectional view showing an image processing apparatus having a sheet feeding mechanism according to an embodiment.

According to an embodiment, the sheet feeding mechanism includes a tray, a first roller, a second roller, a third roller, a first elastic body, and a second elastic body. The tray houses a sheet. The first roller takes out the sheet from the tray and transports the sheet in a take-out direction. The second roller transports the sheet taken out by the first roller. The third roller faces the second roller and sandwiches the sheet between the third roller and the second roller. The second roller and the third roller form a nip in a plane perpendicular to a rotation shaft of the second roller. The first elastic body is located between the nip and the first roller. The first elastic body blocks a first reference line along the take-out direction and a second reference line that connects a contact position and the nip to each other, the first roller being in contact with the sheet at the contact position. The first elastic body further has a first angle formed between the first elastic body and the first reference line, the first angle being an acute angle. The second elastic body is located between the nip and the first elastic body. The second elastic body has a second angle formed between the second elastic body and the first reference line. The second angle is smaller than the first angle.

Hereinafter, a sheet feeding mechanism according to an embodiment will be described with reference to the drawings. The same reference symbols in the drawings will denote the same or similar portions.

In this embodiment, an example in which a sheet feeding mechanism is used for manual sheet feeding of an image processing apparatus will be described. The sheet feeding mechanism may be used for automatic sheet feeding of the image processing apparatus, or the like. FIG. 1 is a schematic cross-sectional view showing an image processing apparatus 1. The image processing apparatus 1 according to the embodiment is an image forming apparatus. The image processing apparatus 1 performs processing of forming an image on a sheet 24. The image processing apparatus 1 includes a housing 15, a scanner 2, an image forming device 3, a sheet supplying device 4, a transport device 5, a sheet feeding mechanism 6, a sheet ejection tray 7, a reversing device 8, a control panel 9, and a controller 12.

The housing 15 forms the outer shape of the image processing apparatus 1. The scanner 2 reads image information of a copy object as light and dark, and generates an image signal. The scanner 2 outputs the generated image signal to the image forming device 3. The image forming device 3 forms, on the basis of the image signal received from the scanner 2 or an image signal received from the outside, an output image using a recording agent such as a toner. Hereinafter, the output image will be referred to as the toner image. The image forming device 3 transfers the toner image onto the surface of the sheet 24. The image forming device 3 heats and pressurizes the toner image on the surface of the sheet 24 to fix the toner image to the sheet 24.

The sheet supplying device 4 supplies the sheet 24 to the transport device 5 one by one in accordance with the timing at which the image forming device 3 forms the toner image. The sheet supplying device 4 includes a supply tray 20, a first supply roller 21, a second supply roller 22, and a third supply roller 23. The supply tray 20 houses the sheet 24 of a predetermined size and type. The first supply roller 21 takes out the sheet 24 one by one from the supply tray 20. The second supply roller 22 transports the sheet 24 taken out by the first supply roller 21 to the transport device 5 toward the downstream side where the sheet 24 is transported. The third supply roller 23 faces the second supply roller 22. The third supply roller 23 sandwiches the sheet 24 between the third supply roller 23 and the second supply roller 22.

The transport device 5 transports the sheet 24 supplied from the sheet supplying device 4 to the image forming device 3. The transport device 5 includes a transport roller 26 and a resist roller 27. The transport roller 26 transports, to the resist roller 27, the sheet 24 supplied from the supply rollers 22 and 23. The transport roller 26 causes the distal end on the downstream side of the sheet 24 to abut against a nip 28 of the resist roller 27. The resist roller 27 adjusts the position of the distal end on the downstream side of the sheet 24 by bending the sheet 24 at the nip 28. The resist roller 27 transports the sheet 24 in accordance with the timing at which the image forming device 3 transfers the toner image to the sheet 24.

Figure 2:
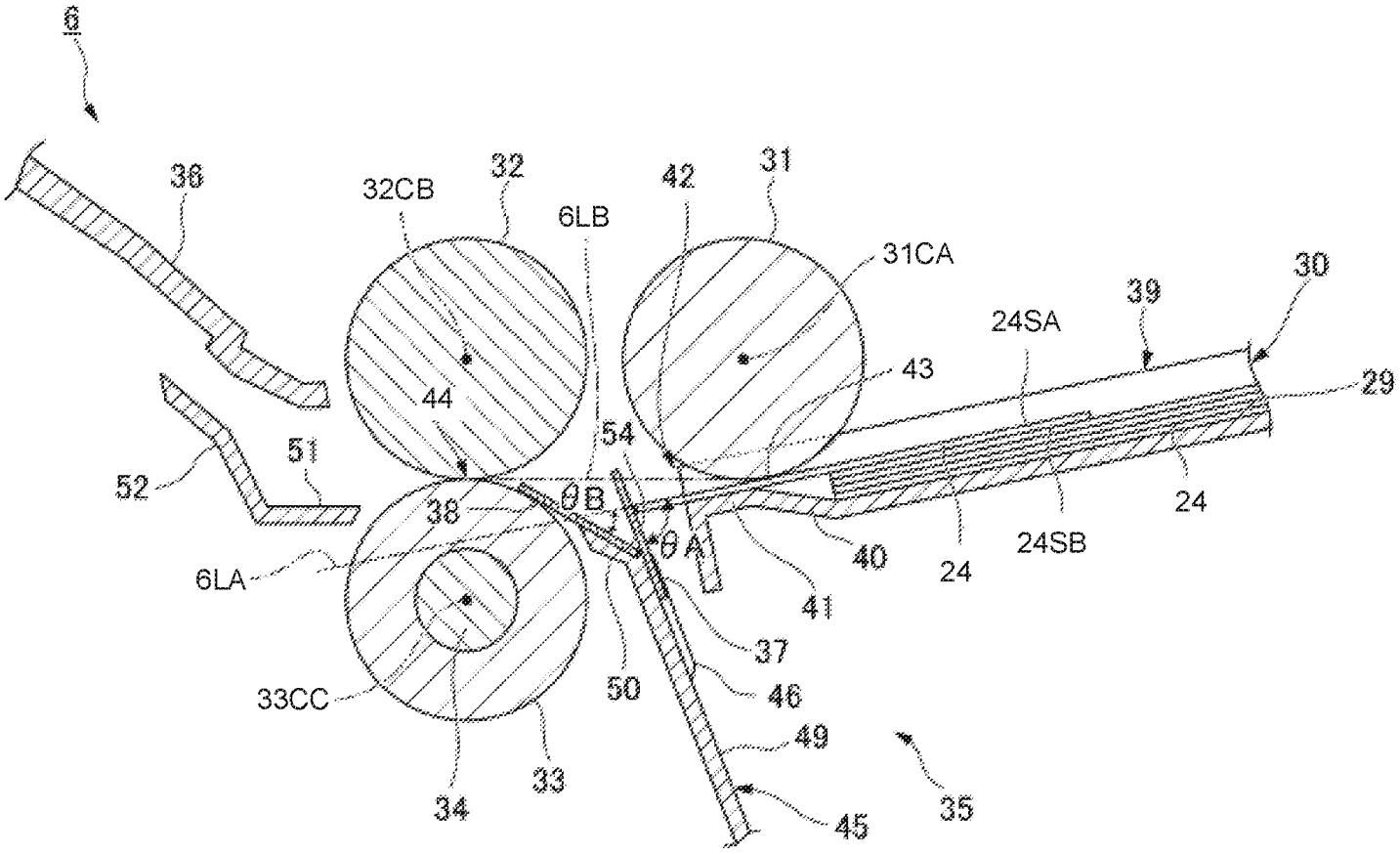
FIG. 2 is a cross-sectional view showing the sheet feeding mechanism according to the embodiment.
Figure 3:
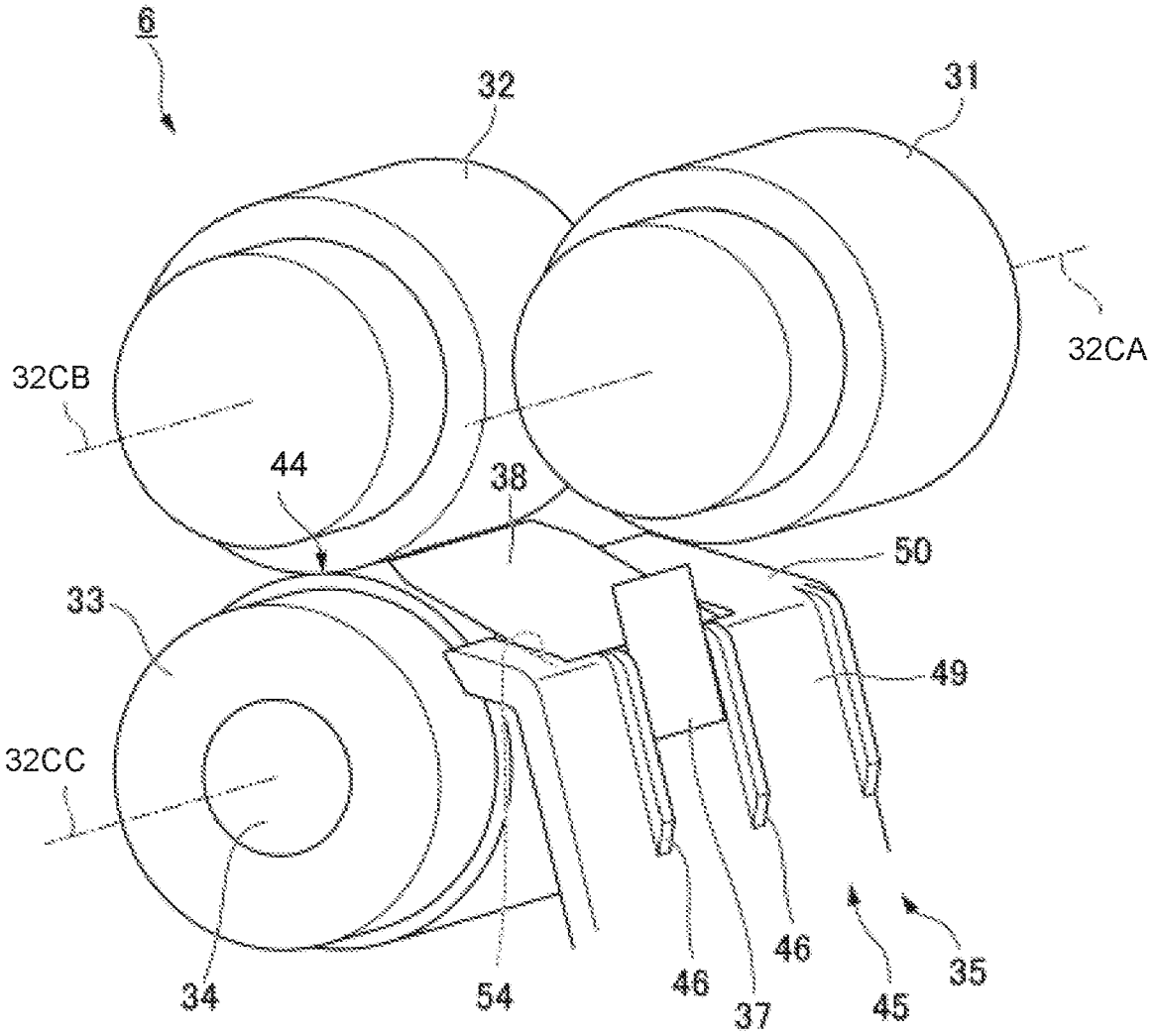
FIG. 3 is a perspective view showing the sheet feeding mechanism according to the embodiment.

The sheet feeding mechanism 6 is a sheet feeding mechanism for sheets to be manually fed. As shown in FIG. 2 and FIG. 3, the sheet feeding mechanism 6 includes a manual feed tray 30, a first roller 31, a second roller 32, a third roller 33, a torque limiter 34, a lower guide 35, an upper guide 36, a first elastic body 37, and a second elastic body 38. Note that in FIG. 2 and FIG. 5, the sheet 24 is shown to be thicker than actual for convenience of description. As shown in FIG. 2, the manual feed tray 30 is a container that houses a plurality of sheets 24 stacked in the thickness direction. The bottom surface of the manual feed tray 30 is a support surface 29 that supports the plurality of sheets 24. The manual feed tray 30 houses the plurality of sheets 24 on the support surface 29. A first opening 39 for housing the plurality of sheets 24 in the manual feed tray 30 is provided on the upper side of the manual feed tray 30.

At the end on the downstream side of the manual feed tray 30, an inclined portion 40 and a flat portion 41. The upper surface of the inclined portion 40 is gradually inclined upward toward the downstream side. The flat portion 41 has a length along the support surface 29 on the downstream side from the end on the downstream side of the inclined portion 40. A second opening 42 for taking out the plurality of sheets 24 housed in the manual feed tray 30 from the manual feed tray 30 is provided on the upper side of the end on the downstream side of the flat portion 41. That is, the downstream side of the manual feed tray 30 on which the sheet 24 is transported is opened. The second opening 42 is connected to the first opening 39. The manual feed tray 30 is gradually inclined downward toward the downstream side.

The manual feed tray 30 is supported by a lifting mechanism (not shown). The manner in which the lifting mechanism supports the manual feed tray 30 will be described below.

As shown in FIG. 2 and FIG. 3, each of the first roller 31, the second roller 32, and the third roller 33 has a cylindrical shape. The first roller 31 is rotatably supported about a rotation shaft 31CA of the first roller 31. For example, the first roller 31 is provided such that the rotation shaft 31CA is along the horizontal plane. FIG. 2 is a cross-sectional view of the sheet feeding mechanism 6 in the plane perpendicular to the rotation shaft 31CA. In other words, FIG. 2 is a cross-sectional view of the sheet feeding mechanism 6 as viewed along the rotation shaft 31CA. As shown in FIG. 2, the rotation shaft 31CA is above a connection portion between the inclined portion 40 and the flat portion 41 in the manual feed tray 30. The first roller 31 takes out the sheet 24 from the manual feed tray 30. Hereinafter, the position at which the first roller 31 comes in contact with the sheet 24 will be referred to as the contact position 43. A reference line along the take-out direction from the sheet 24 taken out by the first roller 31 will be referred to as the first reference line 6LA. The first reference line 6LA has a length along the support surface 29 from the sheet 24 taken out by the first roller 31. The first roller 31 transports the sheet 24 from the contact position 43 in the take-out direction that is on the downstream side along the first reference line 6LA.

As shown in FIG. 2 and FIG. 3, the second roller 32 is on the downstream side of the first roller 31. For example, the second roller 32 is provided such that a rotation shaft 32CB is along the horizontal plane. The second roller 32 transports the sheet 24 taken out by the first roller 31 to the downstream side. The second roller 32 is in contact with a first surface 24SA of the sheet 24. The third roller 33 is provided below the second roller 32 so as to face the second roller 32. For example, the third roller 33 is provided such that a rotation shaft 33CC is along the horizontal plane. The third roller 33 sandwiches the sheet 24 between the third roller 33 and the second roller 32. The second roller 32 and the third roller 33 form a nip 44. The third roller 33 is in contact with a second surface 24SB that is the back side of the first surface 24SA in the sheet 24. The first roller 31, the second roller 32, and the third roller 33 are disposed such that their rotation shafts 31CA, 32CB, and 33CC are parallel to each other. The reference line connecting the contact position 43 and the nip 44 to each other will be referred to as the second reference line 6LB. The plane that includes the center of the second roller 32 in the width direction along the rotation shaft 32CB of the second roller 32 and is perpendicular to the width direction will be referred to as the reference surface. The first roller 31, the second roller 32, and the third roller 33 are symmetrical (plane symmetrical) to each other with respect to the reference surface.

For example, the torque limiter 34 is in the third roller 33. The torque limiter 34 is coaxial with the third roller 33. When a predetermined torque that is equal to or less than a torque threshold value acts between the third roller 33 and the torque limiter 34, the torque limiter 34 rotates around the rotation shaft 33CC integrally with the third roller 33. When a torque exceeding the torque threshold value acts between the third roller 33 and the torque limiter 34, the torque limiter 34 rotatably supports the third roller 33 while accompanying the counter-torque corresponding to the torque threshold value around the rotation shaft 33CC by sliding relative to the third roller 33. That is, the torque limiter 34 imparts a counter-torque on the third roller 33 in order to generate, on the second surface 24SB of the sheet 24, a force on the upstream side on which the sheet 24 is transported. Note that the first roller 31, the second roller 32, and the third roller 33 are controlled such that the linear speed of each of the second roller 32 and the third roller 33 is faster than the linear speed of the first roller 31.

The lower guide 35 includes a support portion 45 and a plurality of protrusions 46. The support portion 45 includes a first support plate 49, a second support plate 50, a third support plate 51, and a fourth support plate 52. The first support plate 49 is provided between the third roller 33 and the manual feed tray 30. The first support plate 49 has a length in the up-and-down direction. In the up-and-down direction, the upper end of the first support plate 49 and the rotation shaft 33CC of the third roller 33 are at positions equivalent to each other.

The above-mentioned lifting mechanism that supports the manual feed tray 30 causes the manual feed tray 30 to move in the up-and-down direction along the first support plate 49 such that the sheet comes into contact with the first roller 31 at the contact position 43. That is, the lifting mechanism holds, when a relatively large number of sheets 24 are housed in the manual feed tray 30, the manual feed tray 30 at a relatively low position. Meanwhile, the lifting mechanism holds, when a relatively small number of sheets 24 are housed in the manual feed tray 30, the manual feed tray 30 at a relatively high position.

The second support plate 50 has a length gradually upward from the upper end of the first support plate 49 toward the third roller 33. A depression 54 that becomes gradually deeper toward the upstream side is provided on the upper surface of the second support plate 50. As shown in FIG. 2, the third support plate 51 has a length in the direction away from the third roller 33 along the horizontal plane from the downstream side of the third roller 33. The fourth support plate 52 has a length gradually upward toward the downstream side from the end on the downstream side of the third support plate 51.

As shown in FIG. 2 and FIG. 3, the plurality of protrusions 46 is provided on the surface of the surface of the first support plate 49 of the support portion 45 facing the upstream side. Each of the plurality of protrusions 46 has a length in the up-and-down direction along the first support plate 49. The plurality of protrusions 46 is spaced apart from each other in the width direction.

As shown in FIG. 2, the upper guide 36 is provided on the downstream side of the second roller 32. The upper guide 36 has a length gradually upward toward the downstream side. The end on the upstream side of the upper guide 36 is above the third support plate 51 and the fourth support plate 52. For example, the lower guide 35 and the upper guide 36 are fixed to the housing 15. The space between the lower guide 35 and the upper guide 36 is directed toward the transport roller 26 (see FIG. 1).

Each of the first elastic body 37 and the second elastic body 38 has a sheet-like shape, and has a rectangular shape when viewed in the thickness direction thereof. Each of the first elastic body 37 and the second elastic body 38 is formed of a polyester resin or the like. Each of the first elastic body 37 and the second elastic body 38 can be elastically deformed easily. The thickness of the first elastic body 37 is thinner than the protruding length of each of the plurality of protrusions 46. The first elastic body 37 is provided between the nip 44 and the first roller 31. As shown in FIG. 2 and FIG. 3, the first elastic body 37 is provided on the first support plate 49 of the support portion 45 between the protrusions 46 adjacent to each other in the width direction. A first end of the first elastic body 37 is attached to the first support plate 49 by a tape having an adhesive layer on both sides of a base material layer (hereinafter, referred to as the double-sided tape), or the like. The first elastic body 37 does not protrude to the upstream side more than the plurality of protrusions 46.

A second end of the first elastic body 37 opposite to the first end has a length above the first support plate 49. The lower end (end on the first end side) of the first elastic body 37 is disposed below the first reference line 6LA and the second reference line 6LB. The first elastic body 37 has a length upward from this lower end. As shown in FIG. 2, the first elastic body 37 blocks each of the first reference line 6LA and the second reference line 6LB. In other words, the surface of the first elastic body 37 facing the upstream side intersects each of the first reference line 6LA and the second reference line 6LB. A first angle θA formed between the first elastic body 37 and the first reference line 6LA is an acute angle. The first angle θA is an angle formed by the surface of the first elastic body 37 facing the upstream side and the first reference line 6LA downward (on the first end side of the first elastic body 37) and on the upstream side. For example, the first angle θA is 45° or more and 80° or less. It is favorable that the upper end of the first elastic body 37 is on the second reference line 6LB or has a length of approximately 1 mm above the second reference line 6LB. It is favorable that the stiffness of the first elastic body 37 is adjusted on the basis of the angle formed between the first reference line 6LA and the first support plate 49, or the like. The first elastic body 37 has the separating function.

The second elastic body 38 is provided between the nip 44 and the first elastic body 37. A first end of the second elastic body 38 is in the depression 54 of the second support plate 50. The first end of the second elastic body 38 is attached to the depression 54 by a double-sided tape or the like. A second end of the second elastic body 38 opposite to the first end has a length on the downstream side of the second support plate 50. The second support plate 50 of the support portion 45 supports the second elastic body 38. The second elastic body 38 has a length on the downstream side of the second support plate 50. A second angle θB formed between the second elastic body 38 and the first reference line 6LA is smaller than the first angle A. The second angle θB is an angle formed by the surface of the second elastic body 38 facing the upstream side and the first reference line 6LA downward (on the first end side of the second elastic body 38) and on the upstream side. Extending the orientation of the second elastic body 38 from the first end to the second end reaches the nip 44. The second elastic body 38 is spaced apart from the third roller 33. The first elastic body 37 and the second elastic body 38 are symmetrical to each other with respect to the reference surface.

The image forming device 3 will be described. As shown in FIG. 1, the image forming device 3 includes a plurality of image forming stations 60, a laser scanning device 61, an intermediate transfer belt 62, a transfer device 63, and a fixing device 64. The image forming stations 60 includes a photoreceptor drum 65. The image forming stations 60 forms, on the photoreceptor drum 65, the tonner image corresponding to the image signal from the scanner 2 or the outside. The plurality of image forming stations 60 forms a toner image by yellow, magenta, cyan, and black toners.

A charger, a developing device, and the like are disposed between the photoreceptor drum 65. The charger charges the surface of the photoreceptor drum 65. The developing device houses a developer containing yellow, magenta, cyan, and black toners. The developing device supplies the toner on the photoreceptor drum 65 to develop an electrostatic latent image on the photoreceptor drum 65. A toner image of the respective colors is formed on the photoreceptor drum 65.

The laser scanning device 61 performing scanning by a laser beam on the charged photoreceptor drum 65 to expose the photoreceptor drum 65. The laser scanning device 61 exposes the photoreceptor drums 65 of the image forming stations 60 of respective colors by laser beams 61Y, 61M, 61C, and 61K of respective colors. The laser scanning device 61 forms the electrostatic latent image on the photoreceptor drum 65.

The toner image on the surface of the photoreceptor drum 65 is primarily-transferred to the intermediate transfer belt 62. The transfer device 63 transfers the toner image primarily-transferred onto the intermediate transfer belt 62 onto the surface of the sheet 24 at the secondary transfer position. The fixing device 64 heats and pressurizes the toner image transferred to the sheet 24 to fix the toner image to the sheet 24.

The reversing device 8 reverses the sheet 24 in order to form an image on the back side of the sheet 24. The reversing device 8 reverses, by switch back, the front and back surfaces of the sheet 24 ejected from the fixing device 64. The reversing device 8 transfers the reversed sheet 24 toward the resist roller 27. The ejected sheet 24 on which an image has been formed is placed on the sheet ejection tray 7. The control panel 9 is part of an input device that inputs information for operating the image processing apparatus 1 by an operator. The control panel 9 includes a touch panel and various hard keys. The controller 12 controls the respective units of the image processing apparatus 1.

Figure 4:
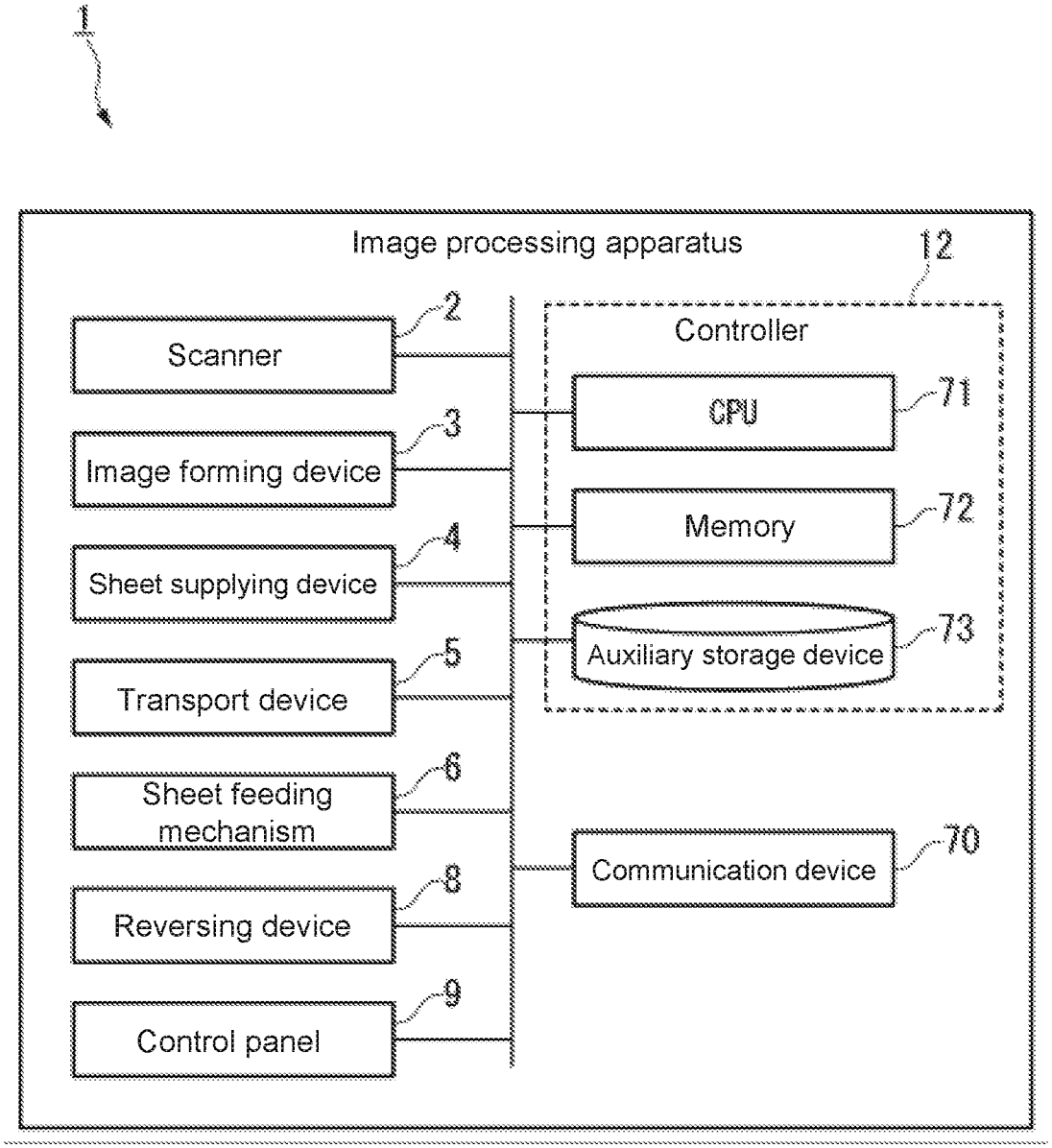
FIG. 4 is a block diagram showing a hardware configuration of the image processing apparatus according to the embodiment.

FIG. 4 is a block diagram showing a hardware configuration of the image processing apparatus 1. The controller 12 of the image processing apparatus 1 includes a CPU (Central Processing Unit) 71, a memory 72, an auxiliary storage device 73, and the like connected to each other via a bus, and executes a program. The image processing apparatus 1 functions, by execution of the program by the controller 12, as an apparatus including the scanner 2, the image forming device 3, the sheet supplying device 4, the transport device 5, the sheet feeding mechanism 6, the reversing device 8, the control panel 9, and a communication device 70.

The CPU 71 functions as the controller 12 by executing the programs stored in the memory 72 and the auxiliary storage device 73. The controller 12 controls the operations of the respective functional units of the image processing apparatus 1. The auxiliary storage device 73 includes a storage device such as a magnetic hard disk drive and a semiconductor storage device. The auxiliary storage device 73 stores information. The communication device 70 includes a communication interface for connecting the image processing apparatus 1 to an external apparatus. The communication device 70 communicates with the external apparatus via a communication interface.

Figure 5:
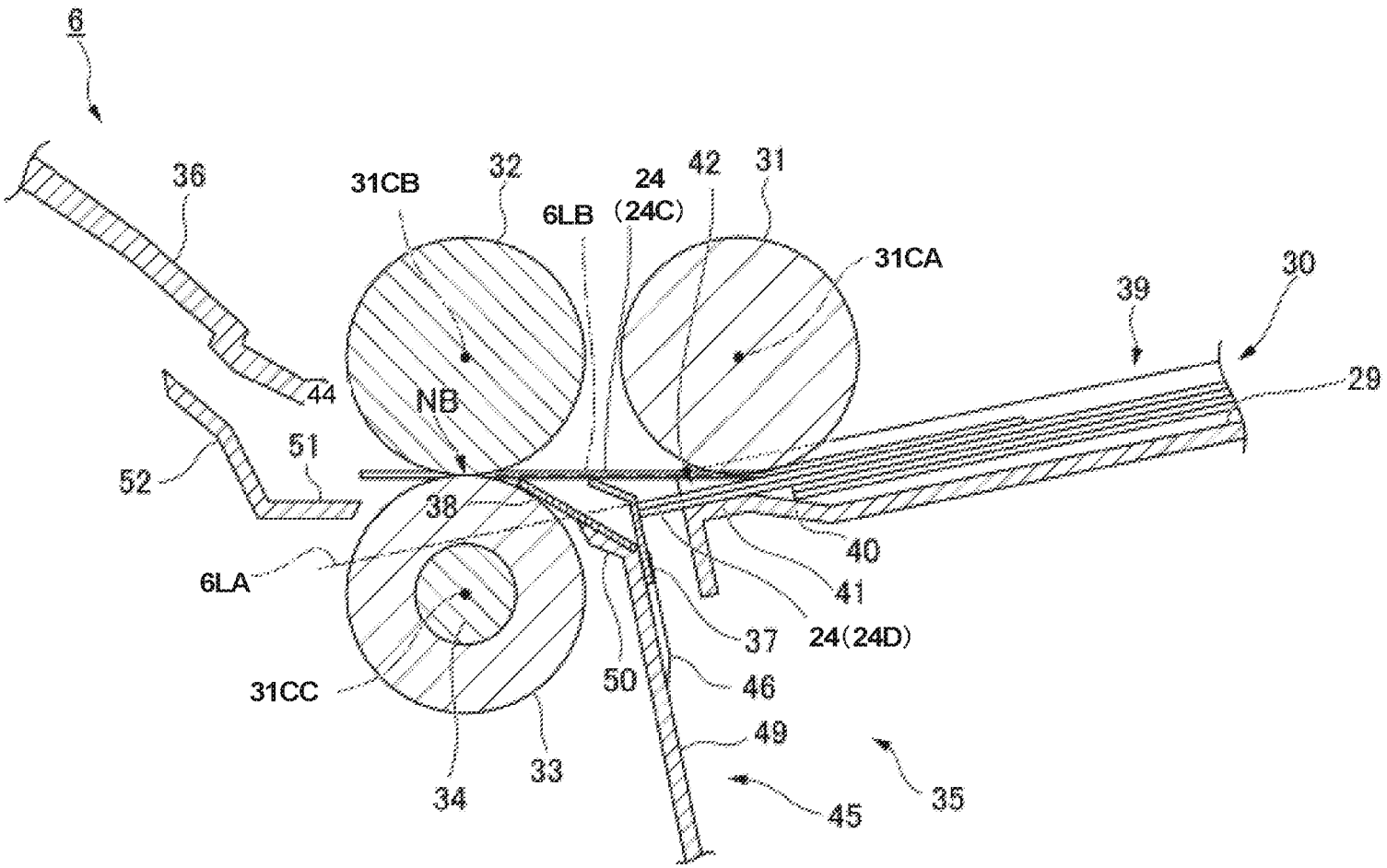
FIG. 5 is a cross-sectional view describing an operation of the sheet feeding mechanism of the image processing apparatus according to the embodiment.
Figure 6:
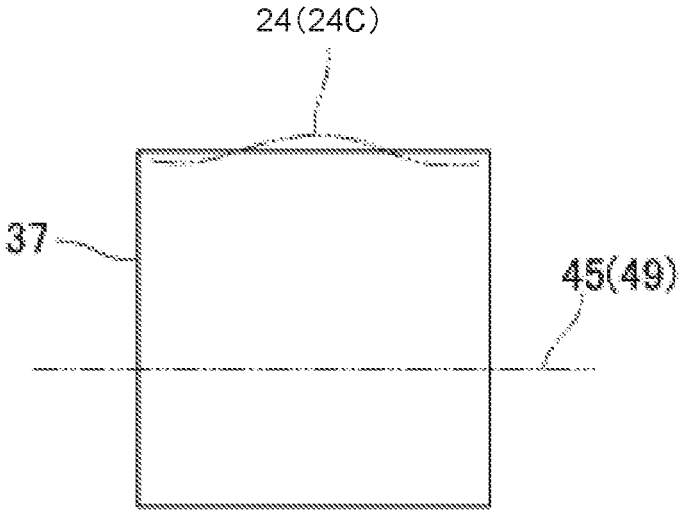
FIG. 6 is a diagram describing an operation of a first elastic body of the image processing apparatus according to the embodiment.

Next, the operation of the image processing apparatus 1 configured as descried above will be described with emphasis on the operation in the sheet feeding mechanism 6. An operator houses the plurality of sheets 24 in the manual feed tray 30 of the sheet feeding mechanism 6. When the image processing apparatus 1 operates by the operation of the control panel 9 by the operator, the first roller 31 rotates in a predetermined direction around the rotation shaft 31CA. Assumption is made that at this time, as shown in FIG. 5, the plurality of sheets 24 is taken out from the manual feed tray in the take-out direction (toward the downstream side). Hereinafter, the sheet 24 located uppermost of the plurality of sheets 24 will be referred to also as the sheet 24C. Of the plurality of sheets 24, the sheets 24 other than the sheet 24C will be referred to also as the sheet 24D. The sheet 24C is transported along the first reference line 6LA in the take-out direction. The sheet 24C abuts against the second end of the first elastic body 37. Since the sheet 24C is transported at high speed, it is subject to air resistance. As shown in FIG. 6, the end of the sheet 24C in the take-out direction deforms in a wavy pattern in the width direction. In FIG. 6, the sheet 24C and the first support plate 49 of the support portion 45 are shown by two-dot chain lines.

Since the first angle θA is an acute angle, the second end of the first elastic body 37 against which the sheet 24C has abutted bends toward the take-out direction. The sheet 24C passes over the first elastic body 37 in the take-out direction. The sheet 24C is guided to the nip 44 by the second elastic body 38. Since the linear speed of each of the second roller 32 and the third roller 33 is faster than the linear speed of the first roller 31, the sheet 24C is transported while being stretched along the second reference line 6LB. The sheet 24D transported together with the sheet 24C abuts against the first elastic body 37, and the upper end of the sheet 24D is closed by the sheet 24C. Air enters between the plurality of sheets 24. The sheet 24D is not transported in the take-out direction more than the first elastic body 37. The sheet 24C is transported in the take-out direction passing between the lower guide 35 and the upper guide 36. The sheet 24C is transported to the resist roller 27.

Even if two sheets 24 are doubly fed to the nip 44, the lower sheet 24 can be separated by the torque limiter 34. The first elastic body 37 is capable of preventing three or more sheets 24 from being doubly fed to the nip 44.

As described above, in the sheet feeding mechanism 6 according to this embodiment, since the first elastic body 37 blocks the first reference line 6LA, the sheet 24C taken out by the first roller 31 from the manual feed tray 30 abuts against the first elastic body 37. Since the first angle θA (see FIG. 2) is an acute angle, the first elastic body 37 against which the sheet 24C has abutted bends in the take-out direction (see FIG. 5). Since the first elastic body 37 blocks the second reference line 6LB, the sheet 24C transported while being stretched along the second reference line 6LB closes the upper portion of the sheet 24D (doubly fed sheet 24D) that has abutted against the first elastic body 37. Since the second angle θB (see FIG. 2) is smaller than the first angle θA, the sheet 24C is guided to the nip 44 by the second elastic body 38. The sheet 24C is transported toward the take-out direction by the second roller 32 and the third roller 33. As described above, in accordance with the sheet feeding mechanism 6, it is possible to prevent the sheets 24 from being doubly fed. The separating function can be realized by an inexpensive member of the first elastic body 37.

The first roller 31, the second roller 32, the third roller 33, the first elastic body 37, and the second elastic body 38 are symmetrical to each other with respect to the reference surface. The sheets 24 of various sizes can be processed with reference to the center in the width direction to form an image on the sheet 24. The first elastic body 37 is provided in the support portion 45 between the protrusions 46 adjacent to each other in the width direction. The thickness of the first elastic body 37 is thinner than the protruding length of each of the plurality of protrusions 46. Even in the case where the sheet 24 is transported from the second opening 42 on the downstream side of the manual feed tray 30, the sheet 24 comes into contact with the plurality of protrusions 46 but does not come into contact with the first elastic body 37. It is possible to stabilize the movement of the first elastic body 37 when the sheet 24 is transported.

The second elastic body 38 is desired to have a function of introducing the sheet 24 into the nip 44 and a function of preventing the sheet 24 from early colliding with the surface of the third roller 33. Meanwhile, the first elastic body 37 is desired to come into contact with the end on the downstream side of each of three or more doubly fed sheets 24 to insert an air layer between the sheets 24, thereby separating the doubly fed sheets 24, i.e., have the separating function. Both the first elastic body 37 and the second elastic body 38 are necessary for the sheet feeding mechanism 6, and a synergistic effect of providing the sheet feeding mechanism 6 capable of stably and reliably feeding one sheet 24 can be achieved.

Figure 7:
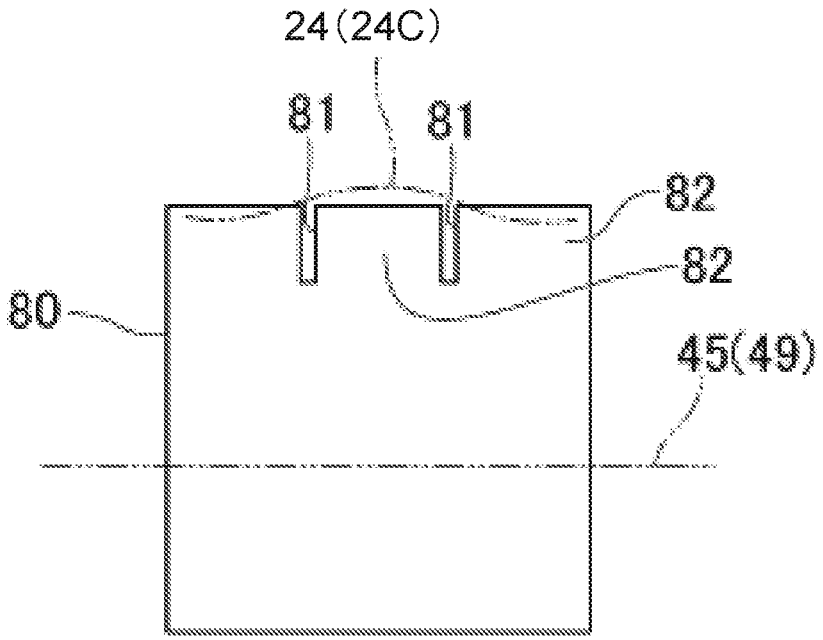
FIG. 7 is a front view showing a first elastic body in a sheet feeding mechanism according to a first modification of the embodiment.

The configuration of the first elastic body 37 of the sheet feeding mechanism 6 according to this embodiment can be variously deformed as described below. As in a first elastic body 80 shown in FIG. 7, a notch 81 may be provided at the end on the downstream side of the first elastic body 80. The notch 81 penetrates the first elastic body 80 in the thickness direction of the first elastic body 80. The notch 81 is opened toward the downstream side. The second end of the first elastic body 80 is divided by the notch 81 into a plurality of elastic pieces 82 in the width direction. The notch 81 makes it possible to prevent a strong external force from acting on the proximal end (end on the upstream side) of the elastic piece 82 against which the sheet 24C does not abut, the external force being generated when the sheet 24C abuts against the proximal end. Although the first elastic body 80 includes a plurality of (two) notches 81 in FIG. 7, but the number of notches 81 of the first elastic body 80 may be one or three or more.

Figure 8:
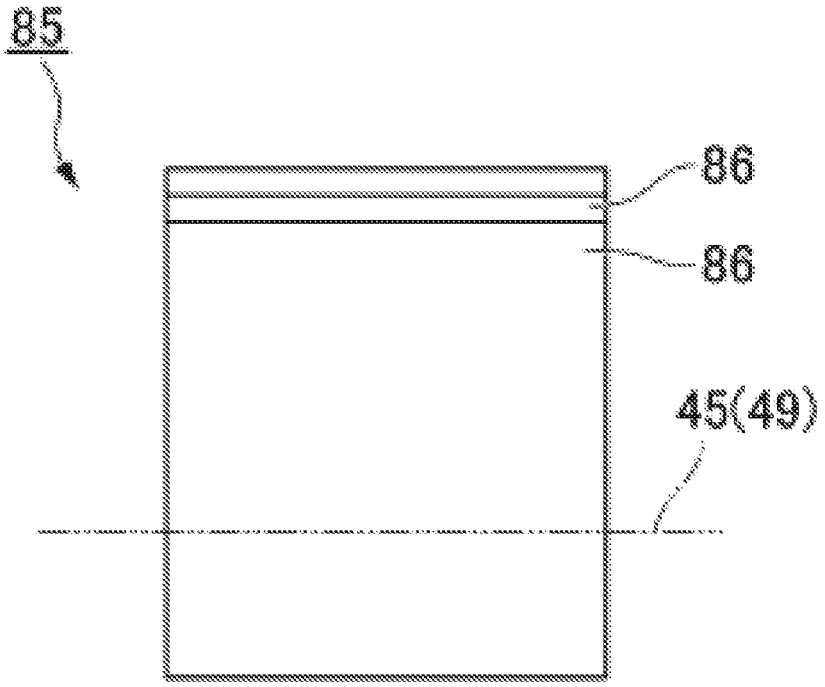
FIG. 8 is a front view showing a second elastic body in a sheet feeding mechanism according to a second modification of the embodiment.
Figure 9:
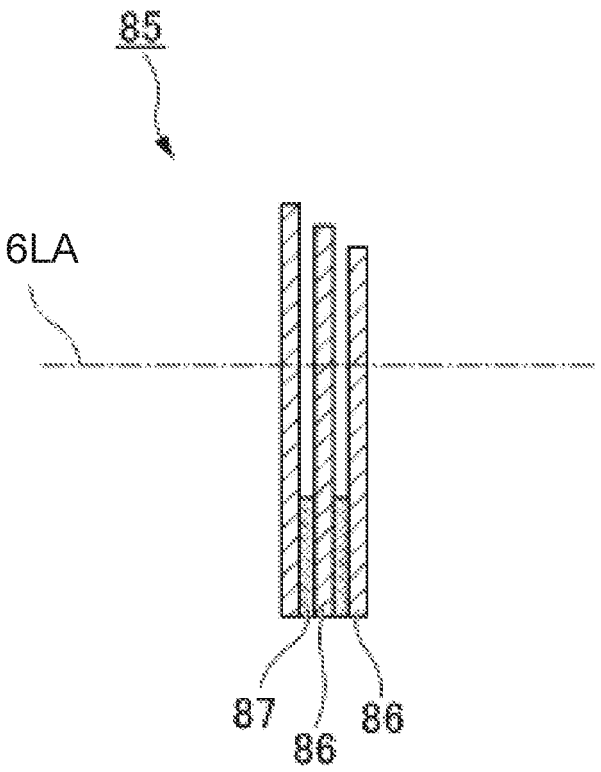
FIG. 9 is a cross-sectional view showing the first elastic body in the sheet feeding mechanism according to the modification of the embodiment.

As shown in FIG. 8 and FIG. 9, a first elastic body 85 may be formed by stacking a plurality of plates 86 along the first reference line 6LA. Of the plates 86 adjacent to each other in the direction along the first reference line 6LA, the distal end on the downstream side of the plate 86 on the downstream side protrudes toward the downstream side more than the distal end on the downstream side of the plate 86 on the upstream side. That is, the distal ends on the more downstream side of the plurality of plates 86 have lengths toward the more downstream side. The stiffness of each of the plates 86 is smaller than the stiffness of the first elastic body 37. The first ends of the plates 86 adjacent to each other in the direction along the first reference line 6LA are attached to each other by a double-sided tape 87. The plates 86 at the portions against which the sheet 24C abuts are not attached to each other.

Since the first elastic body 85 is formed by the plurality of plates 86, when the sheet 24C abuts against one plate 86, the one plate 86 can be easily bent as compared with the case where the sheet 24C abuts against the plurality of plates 86. Further, of the plates 86 adjacent to each other in the direction along the first reference line 6LA, the distal end on the downstream side of the plate 86 on the downstream side protrudes toward the downstream side more than the distal end on the downstream side of the plate 86 on the upstream side. Since the number of the plates 86 stacked along the first reference line 6LA is small, the end on the downstream side of each of the plurality of plates 86 can be easily bent by the sheet 24C. Note that the positions of the distal ends on the downstream side of the plurality of plates 86 may be equal to each other.

The first roller 31, the second roller 32, the third roller 33, the first elastic body 37, and the second elastic body 38 do not necessarily need to be symmetrical to each other with respect to the reference surface. The lower guide 35 does not necessarily need to include the plurality of protrusions 46.

In accordance with at least one of the embodiments described above, it is possible to prevent the sheets 24 from being doubly fed, by including the first elastic bodies 37, 80, and 85.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet feeding mechanism, comprising:

a tray that houses a sheet;

a first roller that takes out the sheet from the tray and transports the sheet in a take-out direction;

a second roller that transports the sheet taken out by the first roller;

a third roller that faces the second roller and sandwiches the sheet between the third roller and the second roller, the second roller and the third roller forming a nip in a plane perpendicular to a rotation shaft of the second roller;

a first elastic body that is located between the nip and the first roller, blocks a first reference line along the take-out direction and a second reference line that connects a contact position and the nip to each other, the first roller being in contact with the sheet at the contact position, and has a first angle formed between the first elastic body and the first reference line, the first angle being an acute angle; and a second elastic body that is located between the nip and the first elastic body, and has a second angle formed between the second elastic body and the first reference line, the second angle being smaller than the first angle.

2. The sheet feeding mechanism according to claim 1, wherein the first elastic body includes a notch on an end on a downstream side on which the sheet is transported.

3. The sheet feeding mechanism according to claim 1, wherein the first elastic body is formed by stacking a plurality of plates along the first reference line.

4. The sheet feeding mechanism according to claim 3, wherein of the plurality of plates adjacent to each other in a direction along the first reference line, a distal end on the downstream side of the plate on the downstream side on which the sheet is transported protrudes toward the downstream side more than a distal end on the downstream side of the plate on an upstream side on which the sheet is transported.

5. The sheet feeding mechanism according to claim 1, further comprising:

a support portion that supports the second elastic body; and a plurality of protrusions that is provided on the support portion and is spaced apart from each other in a width direction along the rotation shaft of the second roller, the first elastic body being provided on the support portion between the protrusions adjacent to each other in the width direction, a thickness of the first elastic body being thinner than a protruding length of each of the plurality of protrusions.

6. The sheet feeding mechanism according to claim 1, wherein the first angle is 45° or more and 80° or less.

7. The sheet feeding mechanism according to claim 1, wherein a linear speed of each of the second roller and the third roller is faster than a linear speed of the first roller.

8. The sheet feeding mechanism according to claim 1, wherein the first roller transports the taken out sheet and causes the sheet to abut against the first elastic body, and an end of the first elastic body against which the sheet has abutted bends toward the take-out direction.

9. The sheet feeding mechanism according to claim 8, wherein the second elastic body guides the sheet that has passed over the bent end of the first elastic body to the nip, and the second roller and the third roller cooperate with the first roller to transport the sheet transported to the nip while stretching the sheet.

10. The sheet feeding mechanism according to claim 9, wherein where the first roller doubly feeds a plurality of sheets from the tray, the second elastic body guides the sheet located uppermost of the plurality of sheets to the nip, the second roller and the third roller cooperate with the first roller to transport the sheet transported to the nip while stretching the sheet, and the first elastic body maintains a state in which sheets other than the sheet located uppermost abut against the first elastic body and the stretched sheet closes an upper portion of the sheets that abut against the first elastic body.

* * * * *